United States Patent [19]

Chandler

[11] 4,273,394

[45] Jun. 16, 1981

[54] APPARATUS FOR SUPPORTINGLY ORGANIZING AND DISPLAYING MISCELLANEOUS ARTICLES

[76] Inventor: Earl E. Chandler, P.O. Box 1624, Coolidge, Ariz. 85228

[21] Appl. No.: 123,387

[22] Filed: Feb. 21, 1980

Related U.S. Application Data

[63] Continuation-in-part of Ser. No. 937,543, Aug. 28, 1978, Pat. No. 4,225,202.

[51] Int. Cl.[3] ..... A47B 63/00; A47F 5/08; A47B 96/06

[52] U.S. Cl. ..... 312/184; 206/349; 206/373; 211/96; 220/4 R; 312/294; 312/DIG. 33

[58] Field of Search ..... 312/244, 184, 189, DIG. 33, 312/294; 211/96, 57.1, 59.1, 168; 248/201, 205 R; 206/349, 372, 373; 223/107; 217/62; 220/4 R

[56] References Cited

U.S. PATENT DOCUMENTS

| | | | |
|---|---|---|---|
| 1,394,936 | 10/1921 | Pratt | 220/4 R |
| 2,136,168 | 11/1938 | Kern | 211/59.1 |
| 3,831,805 | 8/1974 | Yonce | 312/DIG. 33 |
| 4,170,392 | 10/1979 | Spevak | 312/DIG. 33 |

FOREIGN PATENT DOCUMENTS

| | | | |
|---|---|---|---|
| 1249986 | 10/1971 | United Kingdom | 211/96 |

*Primary Examiner*—Alexander Grosz
*Attorney, Agent, or Firm*—Herbert E. Haynes, Jr.

[57] ABSTRACT

An especially configured carrying box has a plurality of cantilever arms demountably and pivotably mounted therein and display panels are demountably suspended from the cantilever arms. The display panels have fastener devices thereon for demountably supporting miscellaneous articles in organized arrays.

11 Claims, 5 Drawing Figures

APPARATUS FOR SUPPORTINGLY ORGANIZING AND DISPLAYING MISCELLANEOUS ARTICLES

CROSS-REFERENCE TO RELATED APPLICATION

This application is a continuation-in-part of a copending U.S. patent application Ser. No. 937,543 filed Aug. 28, 1978, by the same inventor now U.S. Pat. No. 4,225,202.

BACKGROUND OF THE INVENTION

1. Field of the Invention

This invention relates to article supporting structures and more particularly to an apparatus for demountably supporting and displaying miscellaneous articles.

2. Description of the Prior Art

Many article supporting and/or carrying structures have been devised for various articles such as tools, fishing tackle, sewing supplies, and the like, with those prior art structures most often being in the form of a box with a hinged lid and having a multiplicity of trays, drawers, or other compartments formed therein. Such structures, although serving the purpose, are not always convenient to use in that the various types of compartments usually contain a multiplicity of articles which can make access to an individual article somewhat difficult and often delays locating of a desired one of the articles.

In addition to box shaped article carrying structures, the prior art is replete with cabinet structures for containing various articles which are usually supported on shelves or contained within drawers. These cabinet structures often provide the same difficulties as the above described boxes with regard to access to and location of individual articles.

In general, the prior art article supporting and/or carrying structures make no provisions for organized display of the various articles either within the structure or externally thereof, but simply contains those articles in a more or less disorganized manner.

Therefore, it is desirable to provide a new and useful apparatus for supportingly displaying and/or carrying various articles which overcomes some of the problems and shortcomings of the prior art.

SUMMARY OF THE INVENTION

In accordance with the present invention, an apparatus is disclosed for supporting and/or carrying miscellaneous articles in an organized display-like arrangement. The apparatus includes an especially configured carrying box having a base with a floor and one upstanding wall and having a cover which includes a top and three depending walls. The cover is removably attached to the base and is provided with a handle by which it may be carried.

A plurality of cantilever arm means are demountably and pivotably attached to the upstanding wall of the base of the carrying box, and are disposed therein so as to be spaced above the floor of the base. Planar display panels are demountably carried on the cantilever arm means so as to depend therefrom toward the floor of the base of the carrying box, and those display panels are provided with fastener means for supportingly carrying miscellaneous articles in organized arrays.

The cantilever arm means and the special carrying box are configured so that the arms are supported and locked in position for transporting purposes when the cover is mounted on the base of the carrying box. Further, due to the demountability of the individual display panels, they may be easily removed from the cantilever arms for remote displaying purposes, or to provide improved access to the individual articles carried thereon.

Accordingly, it is an object of the present invention to provide a new and improved article supporting and displaying apparatus.

Another object of the present invention is to provide a new and improved article supporting and displaying apparatus which is inexpensive to manufacture and simple to use.

Another object of the present invention is to provide a new and improved article supporting and displaying apparatus in which various miscellaneous articles are demountably supported in organized arrays on removable display panels.

Another object of the present invention is to provide a new and improved article supporting and displaying apparatus of the above described character in which the individual display panels are demountably carried on cantilever arms which are pivotably and demountably carried in an especially configured carrying box.

Still another object of the present invention is to provide a new and improved article supporting and displaying apparatus of the above described character wherein the special carrying box includes a base having a floor with one upstanding wall on which the cantilever arms are demountably and pivotably carried and a cover having three depending walls with the cover being demountably connectable to the base.

The foregoing and other objects of the present invention, as well as the invention itself, may be more fully understood from the following description when read in conjunction with the accompanying drawings.

DESCRIPTION OF THE PREFERRED EMBODIMENT

Figure 1:
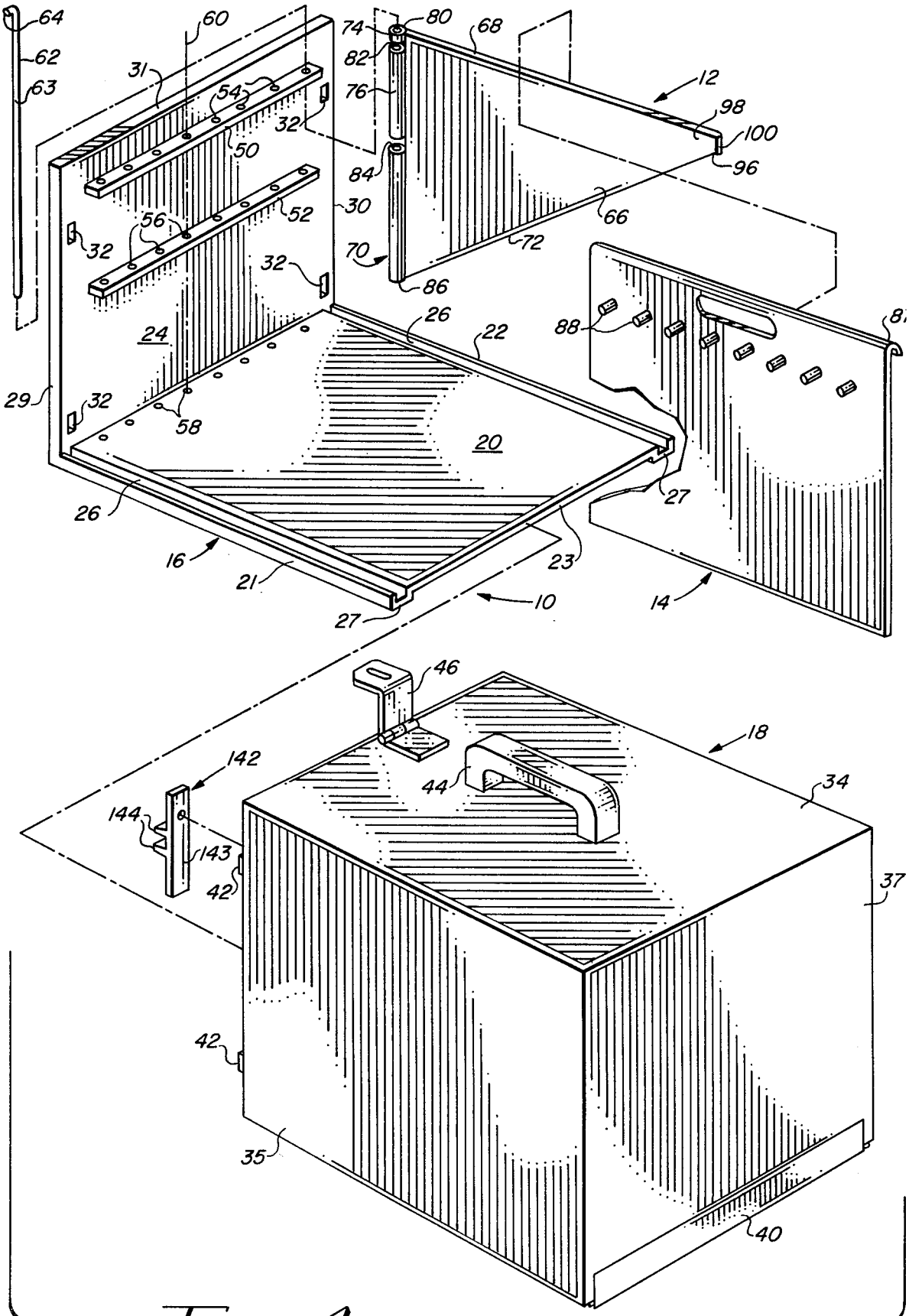
FIG. 1 is an exploded perspective view of the apparatus of the present invention showing the various features of the especially configured carrying box and showing a typical one of the cantilever arms and a typical one of the display panels.

Referring more particularly to the drawings, FIG. 1 illustrates the article supporting and display apparatus of the present invention as including a special carrying box which is indicated generally by the reference numeral 10. FIG. 1 also illustrates a typical one of a plurality of cantilever arm means 12 and a typical one of a plurality of display/organizer panel means 14, which are demountably and pivotably carried in the box 10 as will hereinafter be described in detail.

Figure 3:
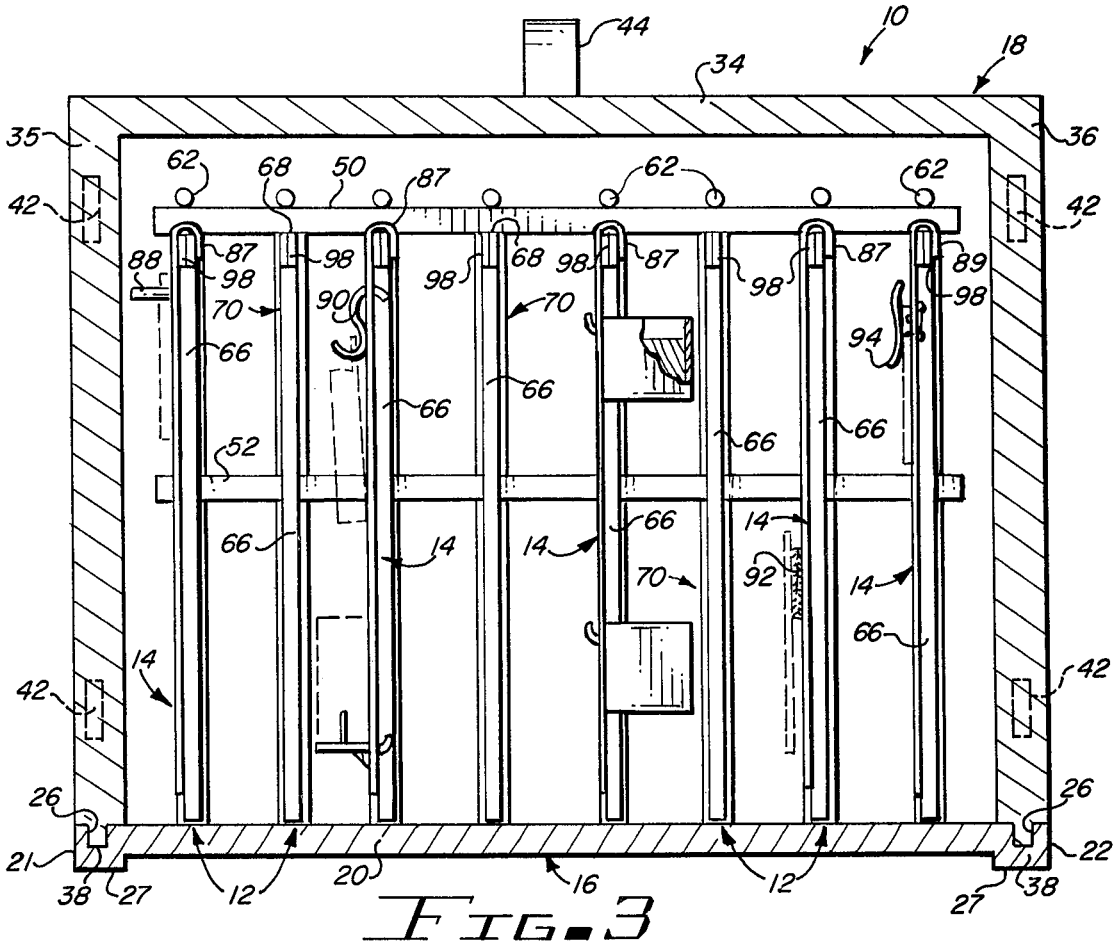
FIG. 3 is a sectional view taken along the line 3—3 of FIG. 2.

The special box 10 includes a base 16 and a cover 18 for demountable interconnection. The base 16 has a planar floor 20 of generally rectangular configuration with opposed side edges 21 and 22, a free end edge 23 with the opposite end edge having an integral upstanding end wall 24 formed thereon. The planar floor 20 is provided with a pair of channels 26 formed in the upwardly facing surface thereof, with the channels each disposed adjacent a different one of the opposite side edges 21 and 22 of the floor and extending longitudinally thereof. As seen best in FIG. 3, the floor 20 is also provided with a pair of ledges 27 which depend from the bottom surface of the floor, and are located adjacent the opposite side edges 21 and 22 and extend longitudinally therealong.

As will hereinafter be described, the channels 26 and ledges 27 are provided in the floor 20 of the base 16 to provide means for demountably interconnecting the base and the cover.

The upstanding end wall 24 of the base 16 is of substantially planar configuration and has opposed side edges 29 and 30, a top edge 31 and is provided with a pair of vertically spaced slots 32 formed adjacent each of the side edges 29 and 30. The slots 32 are provided in the upstanding end wall 24 for demountable interconnection of the base 16 and the cover 18.

The cover 18 is formed with a planar top 34 which is of the same configuration and size as the floor 20 of the base 16, and the top has integral depending sidewalls 35 and 36 with one integral depending end wall 37 so that the end which is opposite the wall 37 is open. The sidewalls 35 and 36 each have an elongated tongue 38 depending from the bottom edge thereof, and the end wall 37 has an angle bracket 40 affixed to its lowermost edge. Further, the sidewalls 35 and 36 each have a pair of spaced tabs 42 extending from the free vertical edges thereof.

Demountable interconnection of the base 16 and the cover 18 is accomplished by placing the tongues 38 of the cover in the channels 26 of the base in an offset position and slidably moving the cover 18 relative to the base 16 so that the open end of the cover will move toward the upstanding end wall 24 of the base. Such sliding movement will bring the angle bracket 40 into hooked engagement with the free end edge 23 of the base floor 20, and will move the tabs 42 of the cover 18 into the slots 32 of the upstanding end wall 24 of the base 16. In this manner, the cover 18 is demountably coupled to the base 16 and is prevented from becoming decoupled as a result of lifting of the box 10.

The cover of the box 10 is provided with a suitable handle means 44 and a suitable hasp 46 is provided for locking the cover to the base.

It will be appreciated that the above described demountable coupling of the base 16 and the cover 18 will relieve all strain on the hasp 46, in that such hasps, or similar devices, in conventional boxes of this general type usually provide the only interconnecting elements which results in their being normally the first elements to fail due to the strain applied thereto.

The inwardly facing surface of the upstanding end wall 24 of the base 16 is provided with an elongated upper plate 50 and an elongated lower plate 52 with those plates being spaced from each other and horizontally disposed in parallel relationship. The upper plate 50 has a plurality of apertures 54 formed therethrough and arranged in spaced increments along the length thereof. Likewise, the lower plate 52 has a similar number of apertures 56 formed therethrough with each of the apertures 56 lying on a vertical axis which is common with one of the apertures 54 of the upper plate 50. Further, the floor 20 of the base 16 has a similar number of apertures 58 formed therein with each of those apertures 58 lying on a different one of the vertical axes defined by the apertures 54 and 56 of the upper and lower plates 50 and 52, respectively. Therefore, the base 16 of the box 10 defines a plurality of spaced vertically extending axes, a typical one of which is shown at 60 in FIG. 1, with each axis 60 having one set of apertures lying thereon, with a set of apertures including one of the apertures 54, one of the apertures 56 and one of the apertures 58.

The hereinbefore mentioned plurality of cantilever arm means 12 are demountably and pivotably connected to the upstanding end wall 24 of the base 16, in a manner which will be described, by a plurality of L-shaped pins 62, with there being one pin demountably slidably carried in each set of the apertures 54, 56 and 58. Each of the L-shaped pins 62 includes an elongated shank 63 having a head portion 64 formed on one end thereof by which the pin is grasped for manual sliding insertion into and removal from its respective one of the aperture sets as will be described.

The plurality of cantilever arm means 12 may be equal in number to the number of aperture sets defined in the base 16 of the box 10, and the plurality of cantilever arm means 12 may be identically configured structures. Thus, the following detailed description of one of the cantilever arms means 12 will be understood to apply to each of those structures.

Figure 2:
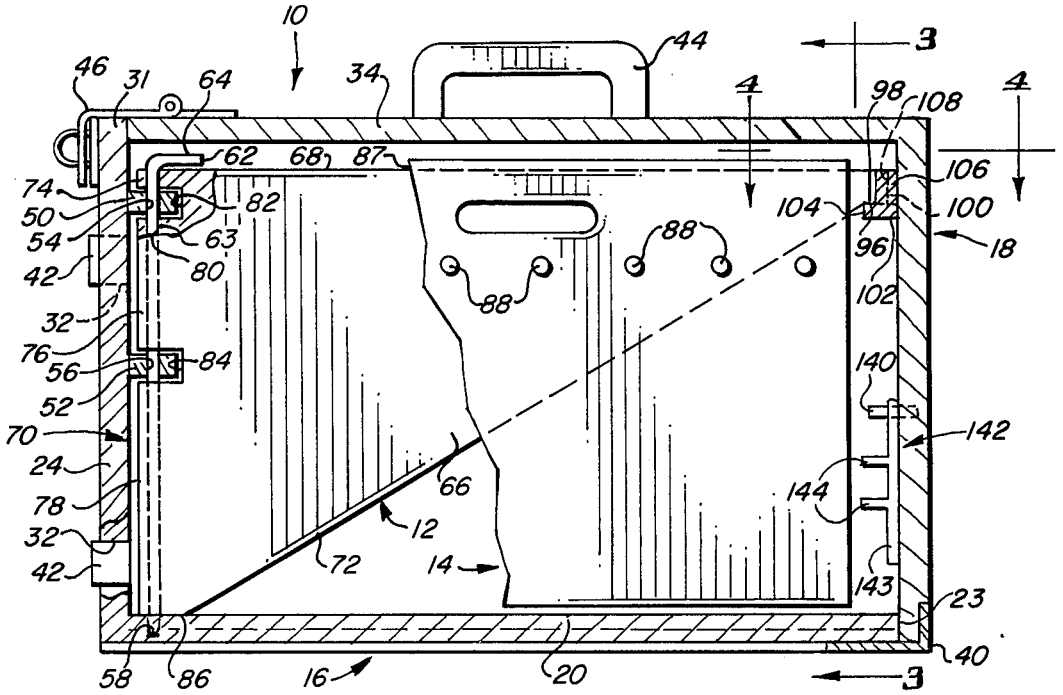
FIG. 2 is a longitudinal sectional view taken along a vertical plane which passes through the assembled apparatus of the present invention, with portions of that apparatus being broken away to show the various features thereof.

The preferred configuration of the cantilever arm means 12 is shown best in FIGS. 1 and 2 as being a substantially planar member 66 of generally triangular configuration. The planar member 66 is defined by a top horizontal edge 68, a special vertically extending multisegment tubular edge 70 and a diagonal edge 72. The special multisegment tubular edge 70 is preferably integrally formed on the member 66 and includes a top tubular member 74, an intermediate tubular member 76 and a lower or bottom tubular member 78. The top, intermediate and bottom tubular members 74, 76 and 78 are in alignment with each other so that the bores thereof collectively define a bore 80 which extends all the way through the multisegment tubular edge 70. The top and intermediate tubular members 74 and 76 are vertically spaced from each other to provide a top gap 82 therebetween which is slightly larger than the thickness dimension of the top plate 50 of the base 16. The intermediate and bottom tubular members 76 and 78 are similarly vertically spaced to provide a bottom gap 84 therebetween which is slightly larger than the thickness dimension of the lower plate 52 of the base 16.

The top and bottom gaps 82 and 84 are spaced from each other so that when the cantilever arm means 12 is placed so that the multisegment tubular edge 70 is adjacent the upstanding wall 24 of the base 16 as shown best in FIG. 2, the top plate 50 is nestingly received in the top gap 82 of the arm 12 and the bottom plate 52 is nestingly received in the bottom gap 84 thereof. When the cantilever arm 12 is in this position, the bore 80 of the multisegment tubular edge 70 will lie along the vertical axis 60 (FIG. 1) defined by one of the aperture sets, and one of the L-shaped pins 62 is slidably inserted through the apertures 54, 56, and 58 of the aperture set and through the bore 80 of the arm 12 to demountably and pivotably attach the cantilever arm means 12 to the base 16 of the box 10. It will now be seen that each of the cantilever arm means 12 will lie in a vertical plane and may be pivotably moved in an arc about its vertical axis 60 (FIG. 1) for access reasons as will become apparent as this description progresses.

As seen best in FIG. 2, a relatively short flat surface 86 is provided on the lowermost part of the planar member 66 at the place where the multisegment tubular edge 70 and the diagonal edge 72 would otherwise intersect. The flat surface 86 is in bearing engagement with the floor 20 of the base which, in conjunction with the three-point mounting arrangement of the planar member 66, i.e., at apertures 54, 56 and 58, will rigidly mount the cantilever arm means 12 in the box 10 in a manner which will resist downward deflection thereof when the arm 12 is supporting the load of the display panel means 14 as will now be described.

The plurality of display/organizer panel means 14, which may be equal in number to the number of cantilever arm means 12, are each of planar configuration and may be fabricated of any suitable material such as wood, plastic, metal, fabric and the like, with the choice of such materials being determined by the articles that are to be displayingly carried thereon.

Each of the display panels 14 has one edge thereof bent back upon itself to form a longitudinally extending hook 87. The panels 14 are demountably suspended from the cantilever arm means 12 by looping their longitudinally extending edge hooks 87 over the top horizontal edges 68 of the cantilever arms 12.

As shown, the display/organizer panel means 14 are each provided with fastener means thereon such as: projecting pegs 88, hooks 90, Velcro fasteners 92, spring clips 94 and the like. The choice of the type of fastener means and the arrangement of those fasteners on the display panels is determined by the articles that are demountably connected thereto.

Figure 4:
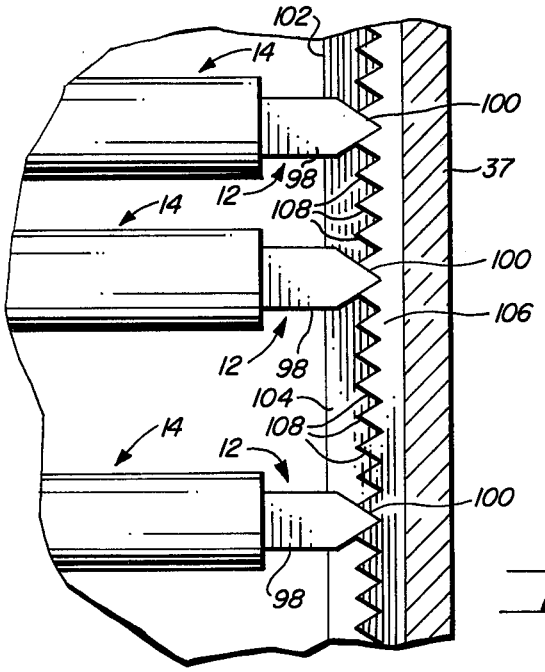
FIG. 4 is an enlarged fragmentary sectional view taken along the line 4—4 of FIG. 2.

As seen best in FIGS. 2 and 4, the diagonal edge 72 which defines the planar member 66 of the cantilever arm means 12 is formed with a relatively short horizontal portion 96 at its uppermost end. The horizontal portion 96 is the bottom surface of an ear 98 which extends from the main surface of the planar member 66, and the ear has its extending vertical edge configured as a wedge 100. The cover 18 of the box 10 is provided with a shelf 102 in the form of an angle bracket which is suitably attached to the inwardly facing surface of the end wall 37 of the cover 18. The shelf 102 is provided with a horizontally extending flange 104 upon which the horizontal portion 96 of the plurality of the cantilever arm means 12 are restingly supported when the cover 18 is mounted on the base 16. The vertical flange 106 of the shelf 102 is especially formed to provide a longitudinally extending series of V-shaped notches 108 which are formed in the inwardly facing surface of the flange 106. When the cover 18 is mounted on the base 16, the extending wedges 100 of the cantilever arm means 12 are nestingly positioned in the notches 108 as shown in FIG. 4. Therefore, the especially configured ears 98 of the cantilever arm means 12 and the special shelf 102 of the cover 18 provide the apparatus of the present invention with means for supporting the cantilever arms and locking them in a position of being perpendicular with respect to the upstanding end wall 24 of the base and preventing pivotal movements thereof during transport and/or storage of the apparatus.

Figure 5:
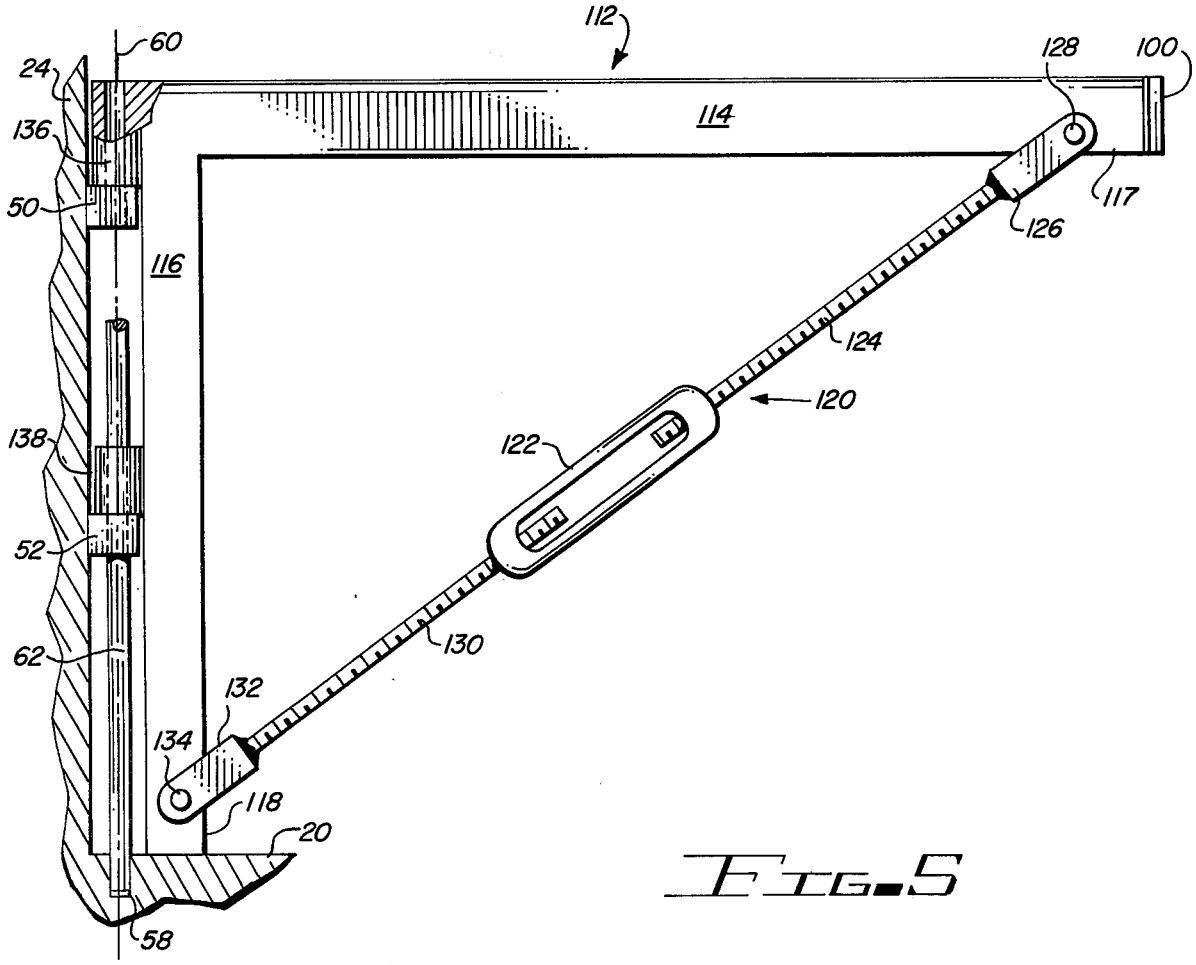
FIG. 5 is an enlarged elevational view of a modified cantilever arm for use in the apparatus of the present invention, with portions of that modified arm being broken away to illustrate the various features thereof.

Referring now to FIG. 5 wherein an alternate form of the cantilever arm means is shown with this alternate form being identified generally by the reference numeral 112. The cantilever arm means 112 includes an L-shaped member having a horizontal strap 114 from one end of which an integral vertical strap 116 depends. The opposite end 117 of the horizontal strap 114 and the lowermost end 118 of the vertical strap 116 are interconnected by a diagonally extending strut means 120. The strut means 120 includes a turnbuckle 122 having a threaded rod 124 extending from one end thereof with a suitable clevis 126 being attached such as by a pin 128 to the horizontal strap 114. An identical threaded rod 130 extends from the other end of the turnbuckle 122 and is attached to the vertical strap 116 by a clevis 132 and suitable pin 134.

The vertical strap 116 of the cantilever arm means 112 is provided with a spaced pair of tubular bosses 136 and 138 which are laterally offset from the strap. The bosses 136 and 138 are in vertical alignment with each other so that the axial bores thereof will lie along the hereinbefore described vertical axis 60 when the arm means 112 is mounted to the base 16 of the box 10.

As seen in FIGS. 1 and 2, the inner surface of the end wall 37 of the cover 18 has a peg 140 extending therefrom for demountably carrying a stand means 142 thereon. The stand means 142 includes a strap member 143 with a spaced pair of ribs 144 extending therefrom intermediate the opposite ends. The stand means 142 is employed for supporting the display panels 14 in an upright position when they are removed from the cantilever arm means 12, or 112, for remote display purposes. Although only one of the stand means 142 is shown, it will be understood that a plurality of such stands, or similar structures, may be mounted within the box 10.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles.

For example, although the apertures 54 and 56 of the upper and lower plates 50 and 52, in conjunction with the apertures 58 of the base 16 form the preferred three-point mounting arrangement for mounting the cantilever arm means in the box, it will be obvious that the lower plate 52 could be eliminated to provide a two-point mounting arrangement. Further, the pin 62 could be considerably shorter and its function of pivotably securing the lower end of the cantilever arm means 12, or 112, could be accomplished by a pin (not shown) which is fixedly attached to the lower end of the cantilever arm means.

The appended claims are therefore intended to cover and embrace any such modifications within the limits only of the true spirit and scope of the invention.

What I claim is:

1. An apparatus for supportingly displaying miscellaneous articles in organized arrays comprising:

(a) a box including,

I. a base having a floor with an upstanding end wall,

II. a cover having a top from which an opposed pair of sidewalls and an end wall depend, and III. means on said base and on said cover for demountably coupling said cover to said base;

(b) at least one cantilever arm means of generally triangular configuration having an elongated horizontal top edge and an elongated vertical side edge;

(c) means adjacent the upper end of the upstanding end wall and in the floor of said base and on said cantilever arm means for demountably and pivotably mounting said cantilever arm in said box so that its elongated vertical side edge lies along a vertical axis adjacent the upstanding end wall of said base and said cantilever arm means is pivotably movable about that vertical axis;

(d) a display panel demountably suspended from said cantilever arm means; and (e) fastener means on said display panel for demountably supporting miscellaneous articles thereon in an organized array.

2. An apparatus as claimed in claim 1 wherein said box further comprises:

(a) said base including,

I. said floor having an opposed pair of side edges and one free end edge,

II. said upstanding wall extending from the opposite end edge of said floor,

III. said floor having a pair of upwardly opening channels formed therein with each channel extending along a different one of the side edges thereof, and IV. said upstanding wall having at least a pair of slots formed therein with each slot adjacent a different vertical side edge thereof; and (b) said cover lowerable onto said base and slidably movable relative thereto, said cover including, I. said top, II. said opposed pair of sidewalls depending from said top and each having a free vertical edge, III. at least one tab extending from each of the free vertical edges of said sidewalls for entry into different ones of the slots of said upstanding wall when said cover is slidably moved relative to said base, IV. a tongue depending from the bottom edge of each of said sidewalls for entry into different ones of the channels of said floor with said tongues slidably movable in those channels when said cover is slidably moved relative to said base, V. said end wall depending from said top, VI. an angle bracket attached to the lower edge of said depending end wall, said angle bracket for hooked engagement with the free end edge of said floor when said cover is slidably moved relative to said base.

3. An apparatus as claimed in claim 1 wherein said means for mounting said cantilever arm means in said box comprises:

(a) a plate on the upstanding end wall of said base of said box said plate being horizontally disposed and having at least one aperture formed therethrough;

(b) said floor of said base having at least one aperture formed therein so as to lie on a vertical axis which is common with the aperture formed through said plate;

(c) said cantilever arm means having a tubular means on the elongated vertical side edge thereof, said cantilever arm means disposed so that the bore of said tubular means lies along the common vertical axis defined by the aperture of said plate and the aperture in the floor of said box; and (d) pin means demountably positioned in the aperture of said plate, the bore of said tubular means and the aperture in the floor of said base.

4. An apparatus as claimed in claim 1 wherein said means for mounting said cantilever arm means in said box comprises:

(a) an upper plate and a lower plate on the upstanding end wall of said base and spaced from each other in parallel horizontally disposed relationship, said upper and said lower plates each having at least one aperture formed therethrough so as to lie on a common vertical axis;

(b) said floor of said base having at least one aperture formed therein so as to lie on the common vertical axis defined by the apertures formed through said upper and said lower plates;

(c) said cantilever arm means having tubular means on the elongated vertical side edge thereof, said cantilever arm means disposed so that the bore of said tubular means lies along the common vertical axis defined by the apertures of said upper and said lower plates and said floor; and (d) pin means demountably positioned in the apertures of said upper and said lower plates in the aperture of said floor and the bore of said tubular means.

5. An apparatus as claimed in claim 1 and further comprising means in said cover for supporting the extending end of said cantilever arm means when said cover is mounted on said base.

6. An apparatus as claimed in claim 1 and further comprising means in said cover and on the extending end of said cantilever arm means for supporting the extending end of said cantilever arm means and lockingly holding it in a perpendicular relationship with respect to the upstanding end wall of said base when said cover is mounted on said base.

7. An apparatus as claimed in claim 6 wherein said means comprises:

(a) an ear extending from the extending end of said cantilever arm means, said ear having a horizontal flat bottom surface and a vertically disposed edge which is wedge-shaped; and (b) an angle bracket on the inwardly facing surface of the end wall of said cover, said angle bracket having a horizontal flange for supportingly engaging the flat bottom surface of said ear and having a vertical flange with a longitudinally extending series of V-shaped notches formed therein for nestingly receiving the wedge-shaped vertical edge of said ear.

8. An apparatus as claimed in claim 1 wherein said cantilever arm means is of planar configuration.

9. An apparatus as claimed in claim 1 wherein said cantilever arm means comprises:

(a) a horizontally extending strap;

(b) a vertically extending strap depending from one end of said horizontal strap; and (c) strut means extending diagonally between the other end of said horizontal strap and the depending end of said vertical strap and connected thereto.

10. An apparatus as claimed in claim 9 wherein said strut means comprises:

(a) a turnbuckle;

(b) a first threaded rod extending from one end of said turnbuckle and connected to the other end of said horizontal strap; and (c) a second threaded rod extending from the other end of said turnbuckle and connected to the depending end of said vertical strap.

11. An apparatus as claimed in claim 1 wherein said display panel means is of planar configuration having one of its edges bent back on itself to form an elongated hook by which said display panel is demountably suspended from said cantilever arm means.

* * * * *